US006915785B2

(12) United States Patent
Eisenmenger et al.

(10) Patent No.: US 6,915,785 B2
(45) Date of Patent: Jul. 12, 2005

(54) FUEL INJECTION SYSTEM FOR INTERNAL COMBUSTION ENGINES

(75) Inventors: Nadja Eisenmenger, Ludwigsburg (DE); Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/910,346

(22) Filed: Aug. 4, 2004

(65) Prior Publication Data

US 2005/0035212 A1 Feb. 17, 2005

(30) Foreign Application Priority Data

Aug. 14, 2003 (DE) ..... 103 37 574

(51) Int. Cl.[7] ..... F02M 47/02

(52) U.S. Cl. ..... 123/446; 123/467; 123/506; 239/88; 239/96; 239/533.3

(58) Field of Search ..... 123/446, 447, 123/467, 468, 495, 497, 506, 514; 239/88–96, 533.1–533.12, 585.1

(56) References Cited

U.S. PATENT DOCUMENTS 5,687,693 A * 11/1997 Chen et al. ..... 123/446
6,283,441 B1 * 9/2001 Tian ..... 251/30.03
6,637,409 B2 * 10/2003 Brenk et al. ..... 123/467
6,655,602 B2 * 12/2003 Shafer et al. ..... 239/5
6,745,952 B1 * 6/2004 Hlousek ..... 239/88
2004/0099246 A1 * 5/2004 Gould ..... 123/446

FOREIGN PATENT DOCUMENTS

EP 1176306 A2 * 1/2002

* cited by examiner

*Primary Examiner*—Weilun Lo
(74) *Attorney, Agent, or Firm*—Ronald E. Greigg

(57) ABSTRACT

A fuel injection system for internal combustion engines having a fuel injection valve communicating with a high-pressure source includes a control valve, which has a valve body with a longitudinally displaceably guided control piston. The control piston is guided in a bush, which is surrounded at least partly inside the valve body by an annular chamber, which communicates with the high-pressure source.

16 Claims, 2 Drawing Sheets

FUEL INJECTION SYSTEM FOR INTERNAL COMBUSTION ENGINES

BACKGROUND OF THE INVENTION

1. Field of the Invention

The invention relates to an improved fuel injection system for internal combustion engines.

2. Description of the Prior Art

A fuel injection system for internal combustion engines of the type with which this invention is concerned is known from European Patent Disclosure EP 1 176 306 A2, in which, for triggering a fuel injection valve, a servo control circuit is provided, having a control valve which has a control piston which is longitudinally displaceable in a bore and which being triggered by an electromagnetic valve as a switching valve realizes the pressure control of the fuel injection valve. The control valve has a first valve seat, which defines a first pressure chamber, and a second valve seat, embodied as a slide seal, which defines a second pressure chamber. The fuel injection system is embodied without a pressure booster interposed between the pressure reservoir and the fuel injection valve.

From German Patent Disclosure DE 101 23 913 A1, a fuel injection system for internal combustion engines with a pressure boosting device for pressure boosting is known in which a 3-way valve is used to control the injector. Such 3-way valves, embodied as servo valves, as a rule have both an electromagnetically or piezoelectrically triggered switching valve and a control valve with a control piston, which is triggered by the switching valve. Control valves of this kind, which are constructed in a seat-slide embodiment, must control a large return quantity of the pressure boosting device. Various pressure chambers for connection to control lines are necessary on the control piston of the control valve here and are subjected from the inside to system pressure (rail pressure, or the pressure to be switched). This pressure burden causes the leakage gaps in high-pressure-tight guides to widen and causes deformation and widening of the control edges of slide seats and high notch tensions at bore intersections. These effects occurring because of the pressure burden impair the function and hence the durability of the servo valve.

OBJECT AND SUMMARY OF THE INVENTION

The fuel injection system of the invention has the advantage that a force proportional to the pressure to be switched is exerted from outside on the valve body, so that the pressure forces acting on the critical parts of the control piston and the valve body are compensated for, and as a result the forces of deformation operative in the control valve can be kept slight. The proportional force is generated by the pressure prevailing in the fuel line; it is furnished by a fuel pump, for example, and is present as the system pressure. As a result, high notch tensions do not occur at the bore intersections of the valve body. Moreover, wear at the control edges of slide seats is reduced. The incident tensions remain markedly below the fatigue strength values, and as a result the production methods to be employed can be simplified, and more-economical materials can be used. This makes it possible to furnish a more-economical fuel injection system.

It is especially expedient to insert the bush in pressure-tight fashion into a receptacle of the valve body and surround it by an annular chamber. An expedient embodiment moreover comprises having a transverse bore lead from the annular chamber into the valve pressure chamber that cooperates with the control piston. Via this transverse bore, the pressure equalization is accomplished between the inner chambers of the control valve and an outer chamber formed by an annular chamber. The invention is especially suitable for triggering fuel injection systems that have a pressure booster; the control edges of the control piston make it possible in alternation to connect a differential pressure chamber of the pressure booster to a high-pressure chamber that communicates with the high-pressure line, or to connect it to a low-pressure system connected to a return line.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
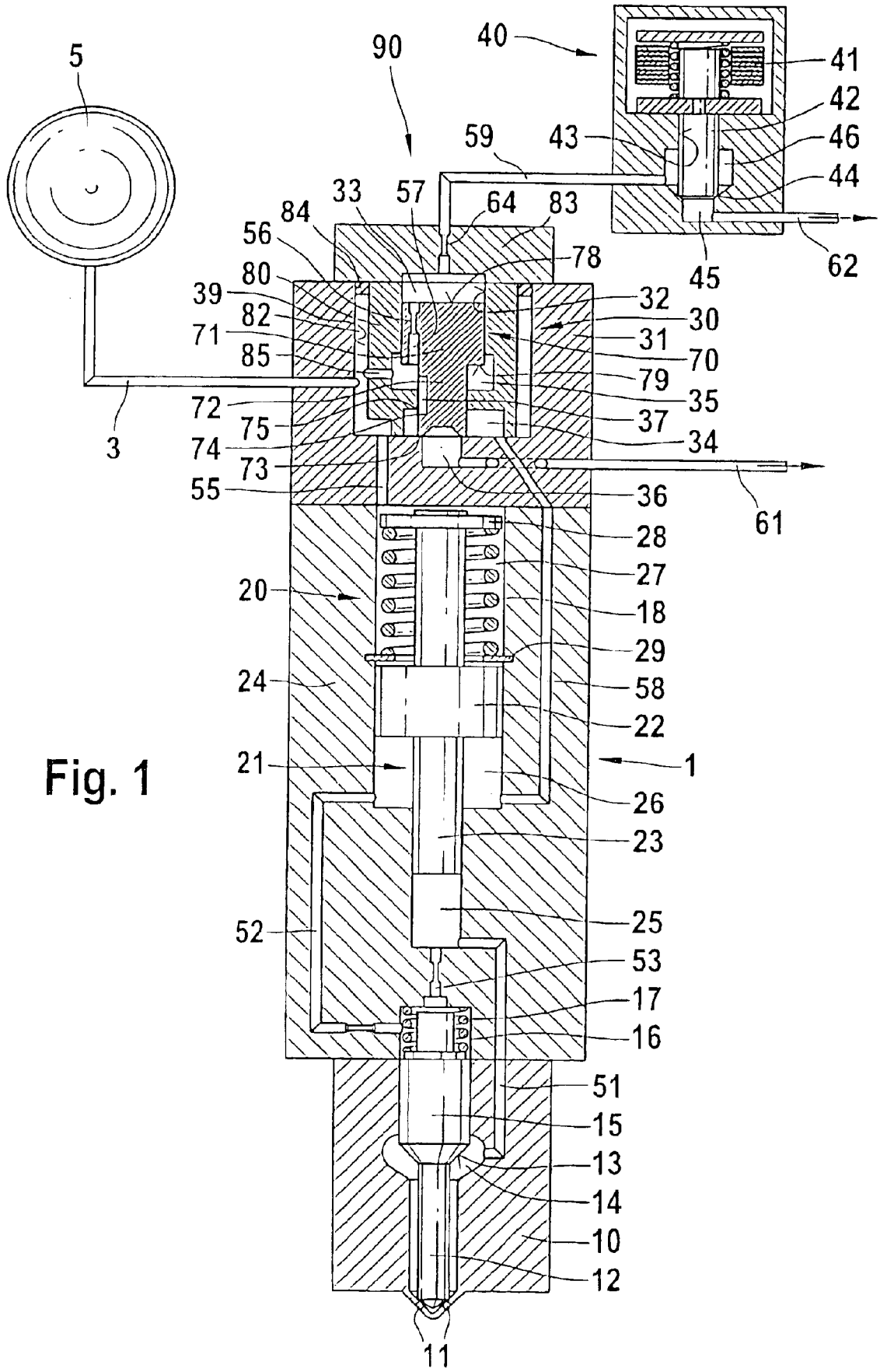
FIG. 1 shows a schematic layout of a fuel injection system in a first exemplary embodiment.

In FIG. 1, a fuel injection system is shown, having a fuel injector 1 that communicates via a fuel line 3 with a high-pressure fuel source 5. The high-pressure fuel source 5 includes a plurality of elements not shown, such as a fuel tank, a high-pressure pump, and a high-pressure line, for instance in a common rail system known per se, in which the pump furnishes a fuel pressure as high as 1600 bar via the high-pressure line. The fuel injector 1 shown has a fuel injection valve 10, which protrudes with injection openings 11 into a combustion chamber of an internal combustion engine. The fuel injection valve 10 has a closing piston 12 with a pressure shoulder 13, which is surrounded by a pressure chamber 14. The closing piston 12 is extended, on an end remote from the combustion chamber, into a guide region 15, which is adjoined by a closing pressure chamber 16. The closing piston 12 is prestressed in the closing direction by means of a closing spring 17.

The fuel injector 1 in FIG. 1, for pressure boosting, has a pressure boosting device 20. The pressure boosting device 20 has a booster piston 21, which is supported resiliently by means of a restoring spring 18 and includes a first partial piston 22 and a smaller-diameter second partial piston 23. Each of the partial pistons 22, 23 is assigned a corresponding cylinder 24, embodied with a graduated diameter, so that the smaller-diameter partial piston 23, in the cylinder 24, divides a high-pressure chamber 25 from a return chamber 26 in fluid-tight fashion. The larger-diameter first partial piston 22, which is guided in the larger-diameter portion of the cylinder 24, also divides the return chamber 26 from a pressure boosting chamber 27 in fluid-tight fashion. The restoring spring 18, to generate a suitable restoring motion for the booster piston 21, is prestressed between a spring holder 28 and a ring element 29 is disposed in the pressure boosting chamber 27.

The fuel injector 1 also has an electrohydraulic servo valve 90, which includes a hydraulic control valve 30 and an electrically triggerable switching valve 40; the triggering is effected by an electromagnetic or piezoelectric actuator 41. The switching valve 40 has an actuator piston 42, which is connected to the actuator 41 and is guided in an actuator bore 43. The actuator piston 42, with a sealing seat 44 on the actuator side, separates a leak fuel chamber 45 on the actuator side from an annular chamber 46 on the actuator side in fluid-tight fashion. However, it is equally possible for the control valve 30 to be embodied as a directly controlled valve. To that end, the actuator 41 is connected directly to the control piston 70, so that the switching motion of the actuator 41 is transmitted directly to the control piston 70, and the switching motion of the actuator 41 carries out the reciprocating motion of the control piston 70.

The control valve 30 has a valve body 31 with a receptacle 39 for a bush 80. In the bush 80, a stepped bore 32 is embodied, which discharges into a control chamber 33 and, on the opposite end, into a connecting chamber 36. Between the control chamber 33 and the connecting chamber 36, the stepped bore 32 forms a valve chamber 34 and a valve pressure chamber 35. In the stepped bore 32 of the control valve 30, a control piston 70 is guided axially displaceably. The control piston 70 is likewise embodied in graduated form, with a first piston portion 71 and a second piston portion 72; the first piston portion 71 has a larger piston diameter than the second piston portion 72. The end face of the first piston portion 71 forms a first pressure face 78. Because of the graduated embodiment of the control piston 70, an annular face is created between the first piston portion 71 and the second piston portion 72 and acts as a second pressure face 79. The first pressure face 78 is larger than the second pressure face 79. A first control edge 73 and a second control edge 74 are also embodied on the control piston 70.

The bush 80 is surrounded in the receptacle 39 by an annular chamber 82, which is closed in pressuretight fashion with a cap 83 and a seal 84 on the valve body 31. The annular chamber 82 is in communication with the fuel line 3 (rail), so that the pressure furnished by the fuel pump 5 prevails as the system pressure in the annular chamber 82, and as a result the bush 80 is acted upon by the system pressure prevailing in the fuel line 3. A transverse bore 85 is made in the bush 80 and connects the annular chamber 82 to the valve pressure chamber 35. From the annular chamber 82, a connecting bore 55 also leads to the pressure boosting chamber 27. A further connecting line 57 leads through the first piston portion 71 and connects the control chamber 33 to the valve pressure chamber 35 via an inlet throttle 56. The fuel line 3 acted upon by system pressure is connected to the annular chamber 82.

A connecting conduit 37 is embodied on the second piston portion 72 and, in the switching position shown, it connects the valve pressure chamber 35 with the valve chamber 34 located upstream of the first control edge 73. A sealing edge 75, which cooperates with the second control edge 74 and together with it, in a second switching position, to be described hereinafter, of the control valve 30, forms a sealing face is embodied on the stepped bore 32.

For connecting the various components, that is, the injection valve 10, pressure boosting device 20, control valve 30 and switching valve 40, pressure lines are used, which are for instance integrated with the fuel injector 1. The pressure chamber 14 of the fuel injection valve 10 communicates, by a first pressure line 51, with the high-pressure chamber 25 of the pressure boosting device 20. From the closing pressure chamber 16 of the injection valve 10, a second pressure line 52 leads to the return chamber 26 of the pressure boosting device 20. In addition, there is a connecting line 53 with a throttle between the closing pressure chamber 16 and the high-pressure chamber 25. The hydraulic pressure of the high-pressure fuel source 5 is carried via the high-pressure line 3 and the connecting bore 55 into the pressure boosting chamber 27 of the pressure boosting device 20. The pressure boosting chamber 27 thus communicates via the transverse bore 85 with the valve pressure chamber 35 of the control valve 30. A return chamber line 58 connects the return chamber 26 of the pressure boosting device 20 with the valve chamber 34 of the control valve 30.

From the connecting chamber 36 of the control valve 30, a first return line 61 leads, via a low-pressure system not shown in the drawing, back into a fuel tank, also not shown. The control chamber 33 of the control valve 30 communicates by means of a control line 59, via an outlet throttle 64, with the annular chamber 46 on the actuator side of the switching valve 40. Finally, a second return line 62 leads out of the leak fuel chamber 45 toward the actuator of the switching valve 40 into the low-pressure or return system. The return lines 61, 62 may, however, be embodied as one common return system instead.

Figure 2:
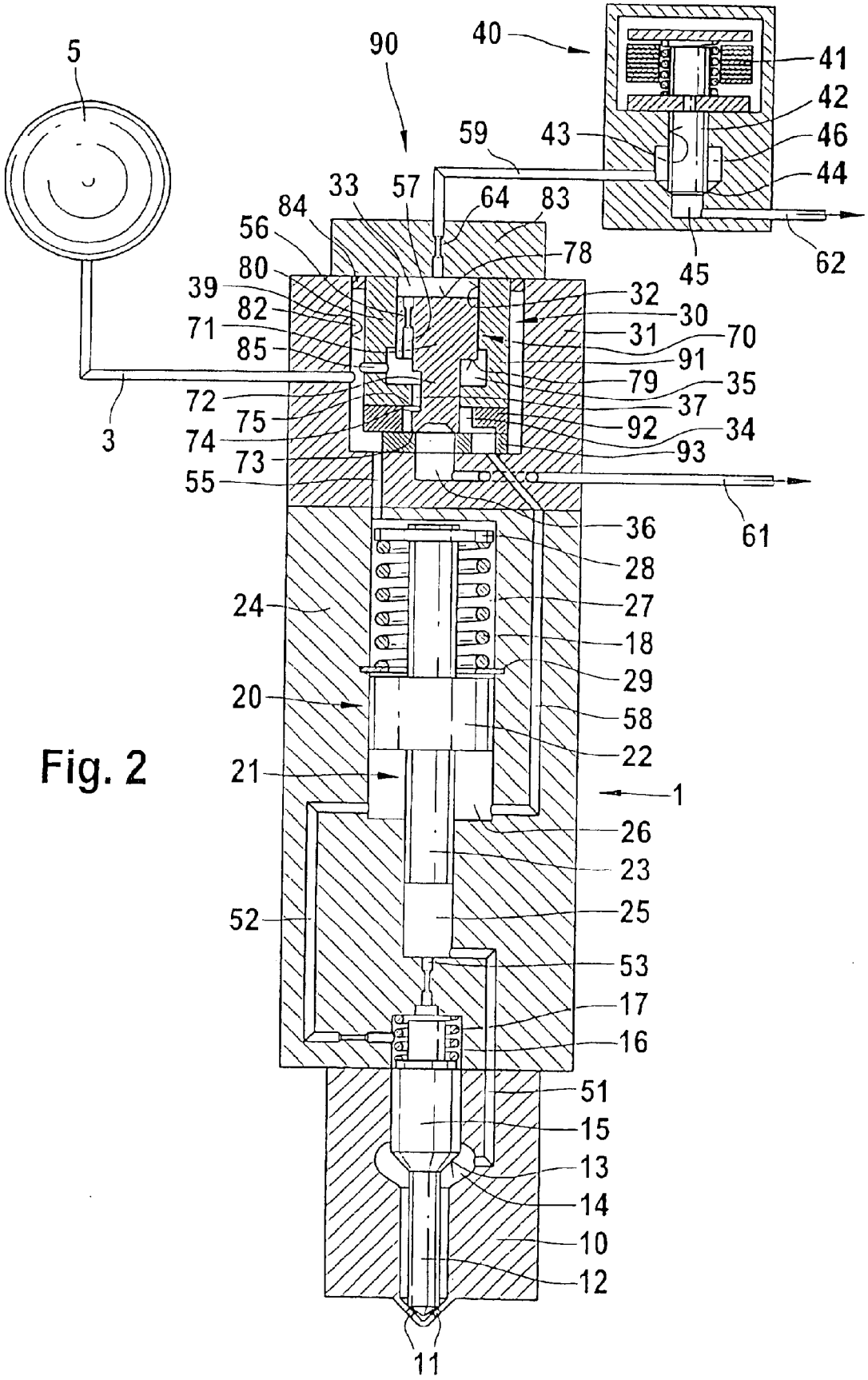
FIG. 2 shows a schematic layout of a fuel injection system in a second exemplary embodiment.

A second exemplary embodiment is shown in FIG. 2. In this exemplary embodiment, the same components of the fuel injector 1 are identified by the same reference numerals. The special feature of the exemplary embodiment of FIG. 2 in comparison to the exemplary embodiment of FIG. 1 is that the bush 80 is embodied in multiple parts. In the present exemplary embodiment, the bush 80 has a valve chamber bush 91, an adjusting bush 92, and a valve plate 93. The valve chamber bush 91 essentially has the same function as the one-piece bush 80 in the exemplary embodiment of FIG. 1. By means of the adjusting bush 92 axially adjoining the valve chamber bush 91, it is possible to adjust the position of the sealing edge 75 that cooperates with the second control edge 74. As a result, the adjusting bush 92 can be furnished in various thicknesses as a group to select from. In this respect it is possible, by a suitable choice of the thickness of the adjusting bush 92, to design the position of the sealing edge 75 on the valve chamber bush 91 as axially adjustable. The valve plate 93 is provided optionally, in the event that direct sealing on the valve body 31 at the seat of the first control edge 73 is not possible for reasons of the materials involved. In that case, the valve plate 93 should be embodied of a material suitable for the embodiment of a valve seat required for the second control edge 74.

The mode of operation of the fuel injector 1 is as follows: At the onset of the injection event, because of the constant pressure in the high-pressure reservoir 5, the pressure prevailing in the pressure boosting chamber 27 also prevails, via the return chamber line 58, in the return chamber 26 and, via the second pressure line 52 and the connecting line 53, in the high-pressure chamber 25 and from there, via the first pressure line 51, in the pressure chamber 14. The actuator 41 of the switching valve 40, which in the present exemplary embodiment is an electromagnetic valve is supplied with current such that the actuator piston 42 closes the control line 59, which communicates with the control chamber 33 of the control valve 30, off against the leak fuel chamber 45 on the actuator side that communicates with the second return line 62. As a result, the same pressure prevails in the control chamber 33 as in the annular chamber 82, which communicates with the pressure boosting chamber 27 via the further connecting line 57. Because of the high pressure acting on the first pressure face 78, the first control edge 73 is pressed against the sealing seat. As a result, the valve chamber 36 and with it the first return line 61 are decoupled from the high pressure or system pressure. The injection valve 10 is closed.

The opening stroke motion of the closing piston 12 of the injection valve 10 is initiated by the lifting of the actuator piston 42 from the sealing seat 44 on the actuator side, which occurs with suitable delivery of current to the actuator 41, so that the control chamber 33 is made to communicate with the annular chamber 46 toward the actuator and with the connecting bore 55 toward the pressure booster. The flow resistances of the inlet throttle 56 and outlet throttle 64 should be dimensioned such that the pressure in the control chamber 33 drops, and the control piston 70 lifts from the sealing seat of the first control edge 73. Simultaneously, the pressure in the pressure boosting chamber 27 acts on the second, smaller pressure face 79, causing it to continue its opening motion and, with the second control edge 74, closing the valve pressure chamber 35 toward the valve chamber 34 and blocking off the high pressure from the connecting chamber 36. As a result, the return chamber 26 is made to communicate with the first return line 61, via the return chamber line 58, the valve chamber 34, and the connecting chamber 36. Accordingly, the high pressure prevailing in the return chamber 26 of the pressure boosting device 20 is depressurized via the return line 61, and the pressure in the return chamber 26 drops. As a result, the pressure boosting chamber 27*e* is activated, and the second partial piston 23, which has the smaller effective surface area, compresses the fuel in the high-pressure chamber 25, so that in the pressure chamber 14 communicating with the high-pressure chamber 25, the pressure force engaging the pressure shoulder 13 in the opening direction rises, and the closing piston 12 uncovers the injection openings 11. As long as the return chamber 26 is pressure-relieved, the pressure boosting device 20 remains activated and compresses the fuel in the high-pressure chamber 25.

For terminating the injection event, the switching valve 40 is returned to its outset position. This disconnects the return chamber 26 from the first return line 61 and connects it to the supply pressure of the high-pressure fuel source 5 again. As a result, the pressure in the high-pressure chamber 25 drops to system pressure, so that system pressure prevails again in the pressure chamber 14 as well. The restoration of the closing piston 12 is reinforced by the closing spring 17 disposed in the closing pressure chamber 16 and is realized by the system pressure also prevailing via the second pressure line 52. After the pressure equilibrium, the pressure booster piston 21 is returned to its outset position by the restoring spring 18, and the high-pressure chamber 25 is filled from the high-pressure fuel source 5 via the connecting line 53.

The foregoing relates to preferred exemplary embodiments of the invention, it being understood that other variants and embodiments thereof are possible within the spirit and scope of the invention, the latter being defined by the appended claims.

We claim:

1. A fuel injection system for internal combustion engines, comprising a fuel injection valve communicating with a high-pressure source, and a control valve (30) which has a valve body (31) with a longitudinally displaceably disposed control piston (70), in which the control piston (70), in a first valve position, disconnects a pressurized valve chamber from a return or low-pressure system, and in which in a second valve position of the control piston (70), a depressurization of the valve chamber to the return system is effected, thereupon initiating an actuation of the fuel injection valve (10), the control piston (70) being guided in a bush (80), which at least partially inside the valve body (31) is subjected from outside to pressure.

2. The fuel injection system in accordance with claim 1, wherein the bush (80) in the valve body (31) is at least partly surrounded by an annular chamber (82) which is connected to the high-pressure source (5).

3. The fuel injection system in accordance with claim 1, further comprising a transverse bore (85) embodied on the bush (80) and establishing a hydraulic connection from an annular chamber (82) to a valve pressure chamber (35).

4. The fuel injection system in accordance with claim 2, further comprising a transverse bore (85) embodied on the bush (80) and establishing a hydraulic connection from the annular chamber (82) to a valve pressure chamber (35).

5. The fuel injection system in accordance with claim 1, wherein the bush (80) is inserted in pressuretight fashion into a receptacle (39) of the valve body (31).

6. The fuel injection system in accordance with claim 2, wherein the bush (80) is inserted in pressuretight fashion into a receptacle (39) of the valve body (31).

7. The fuel injection system in accordance with claim 3, wherein the bush (80) is inserted in pressuretight fashion into a receptacle (39) of the valve body (31).

8. The fuel injection system in accordance with claim 4, wherein the bush (80) is inserted in pressuretight fashion into a receptacle (39) of the valve body (31).

9. The fuel injection system in accordance with claim 1, wherein the bush (80) is embodied in multiple parts and axially one after the other has at least two partial bushes (91, 92).

10. The fuel injection system in accordance with claim 9, wherein via the thickness of the second partial bush (92), the axial position of the first partial bush (91) in the valve body (31) is adjustable.

11. The fuel injection system in accordance with claim 9, wherein the first partial bush (91) encloses a valve pressure chamber (35) that can be subjected to pressure, the first partial bush (91) having a sealing edge (75) that cooperates with a control edge (74) on the control piston (70), and wherein by means of the axial length of the second partial bush (92), the axial position of the sealing edge (75) relative to the control edge (74) is adjustable.

12. The fuel injection system in accordance with claim 10, wherein the first partial bush (91) encloses a valve pressure chamber (35) that can be subjected to pressure, the first partial bush (91) having a sealing edge (75) that cooperates with a control edge (74) on the control piston (70), and wherein by means of the axial length of the second partial bush (92), the axial position of the sealing edge (75) relative to the control edge (74) is adjustable.

13. The fuel injection system in accordance with claim 9, further comprising a third partial bush (93) on which a valve seat is embodied via a first control edge (73) embodied on the control piston (70).

14. The fuel injection system in accordance with claim 1, wherein the control valve (30) cooperates with a switching valve (40), the control valve (30) and the switching valve (40) forming a servo valve unit (90).

15. The fuel injection system in accordance with claim 1, further comprising a pressure boosting device (20) having a pressure booster piston (21) connected between the high-pressure source (5) and the fuel injection valve (10) and being controlled by the control valve (30).

16. The fuel injection system in accordance with claim 15, wherein the pressure boosting device (20) comprises a return chamber (26), which cooperates with the pressure booster piston (21) and is triggerable by the control valve (30), so that via a pressure change in the return chamber (26), a pressure boost acting on the fuel injection valve (10) is effected.

* * * * *